United States Patent [19]

Quang et al.

[11] 3,980,475

[45] Sept. 14, 1976

[54] PROCESS OF TRANSFERRING AN ELECTROSTATIC LATENT IMAGE TO A DIELECTRIC SUPPORT

[75] Inventors: Pham Kim Quang, Dieppe; Guy Weber, Arques la Bataille, both of France

[73] Assignee: La Cellophane, Paris, France

[22] Filed: July 11, 1975

[21] Appl. No.: 595,149

Related U.S. Application Data

[63] Continuation of Ser. No. 378,695, July 12, 1973, abandoned.

[30] Foreign Application Priority Data

July 27, 1972 France ..... 72.27027

[52] U.S. Cl. ..... 96/1 TE; 355/3 R; 355/16

[51] Int. Cl.[2] ..... G03G 13/18

[58] Field of Search..... 96/1 TE, 1 C; 355/3 TE, 355/16

[56] References Cited

UNITED STATES PATENTS

| | | | |
|---|---|---|---|
| 2,825,814 | 3/1958 | Walkup | 96/1 R X |
| 2,833,930 | 5/1958 | Walkup | 96/1 R |
| 3,076,968 | 2/1963 | Schwartz | 96/1 R |
| 3,146,100 | 8/1964 | Kaufman | 96/1 R |
| 3,355,288 | 11/1967 | Matkan | 96/1 R |
| 3,429,701 | 2/1969 | Koehler | 96/1 R |
| 3,438,772 | 4/1969 | Gundlach | 96/1 R |
| 3,539,255 | 11/1970 | Goffe | 96/1 R X |
| 3,583,868 | 6/1971 | Nobel et al. | 96/1 TE |
| 3,609,031 | 9/1971 | Kinoshita | 96/1 C |
| 3,645,729 | 2/1972 | Goffe | 96/1 R |
| 3,664,833 | 5/1972 | Tanaka | 96/1 R |
| 3,703,376 | 11/1972 | Gundlach et al. | 96/1 R |
| 3,738,855 | 6/1973 | Gundlach | 96/1 R X |
| 3,775,104 | 11/1973 | Matsumoto et al. | 96/1 C X |
| 3,784,300 | 1/1974 | Hudson et al. | 96/1 R X |
| 3,798,029 | 3/1974 | Saklikar | 96/1 R |
| 3,830,645 | 8/1974 | Zweig | 96/1 TE X |

FOREIGN PATENTS OR APPLICATIONS

| | | | |
|---|---|---|---|
| 39-27578 | 1/1964 | Japan | 96/1 R |
| 46-11958 | 3/1971 | Japan | 96/1 C |

OTHER PUBLICATIONS

Schaffert, *Electrophotography*, 1965, pp. 87–96.

*Primary Examiner*—David Klein
*Assistant Examiner*—John R. Miller
*Attorney, Agent, or Firm*—Sherman & Shalloway

[57] ABSTRACT

An improved electrophotographic process, where the image to be reproduced is transferred onto a photoconductive support as an image of electric charges, in which image of charges is transferred from a photoconductive support in virtual contact with a dielectric support to the dielectric support, the improvement comprising completely discharging the photoconductive support before or at the instant of separation of the dielectric support and photoconductive support. The electrophotographic reproduction apparatus of the present application comprises means for producing an electrostatic image on a dielectric support means to bring said dielectric support into virtual face-to-face contact with a photoconductive support, means to transfer the electrostatic image to the dielectric support from the photoconductive support, and means to completely discharge the photoconductive support subsequent to the transfer of charges but before the separation of the dielectric support and photoconductive support.

5 Claims, 2 Drawing Figures

PROCESS OF TRANSFERRING AN ELECTROSTATIC LATENT IMAGE TO A DIELECTRIC SUPPORT

This is a continuation of application Ser. No. 378,695, filed July 12, 1973, now abandoned.

BACKGROUND OF THE INVENTION

This invention relates to a process and apparatus for electrophotographic reproduction utilizing a virtual image of an electrostatic charge on a conductive support and transferring this image to a dielectric support followed by developing and fixing the image so as to make the same visible and permanent. More particularly, this invention relates to an improved process wherein defects and background imperfections resulting from the separation of the dielectric support and the photoconductive support are reduced or eliminated.

Although the general process for producing electrophotographic images by forming an electrostatic charge on a conductive support coated with a photoconductive layer followed by transferring of this image onto a dielectric layer with subsequent developing and fixing of the image is well known, these processes present serious difficulties since there is an undesirable discharge when the two supports are separated subsequent to the transfer of the charge image. As noted above, the electrophotographic process involves the bringing of a dielectric support and a photoconductive support into close or into virtual contact, either statically or dynamically, so that the transfer of charges can occur under the influence of an electric field. when these two supports are separated, prior to fixing and developing the image transferred to the dielectric support, discharges occur which cause the appearance of configurations known as Lichtenberg figures which are also developed during developing, causing a disagreeable and irreglar background on the copy sheet. This phenomenon is believed to be caused by the photoconductive surface carrying a residual charge which has not been completely discharged subsequent to transfer so that it remains partially dielectric, thereby causing a separation between what is in reality two dielectric surfaces.

Prior art attempts to remove this difficiency in the basic process by the short-circuiting of the two supports prior to separation or establishing at separation a field opposite that utilized for effecting the transfer have only given partial relief to the problem of dielectric discharge creating undesirable backgrounds.

BRIEF DESCRIPTION OF THE INVENTION

It is within the above environment and background, however, that the process and apparatus of the present invention was developed. Briefly, it has been found in accordance with the present invention that this problem can be eliminated so as to produce copies having virtually no undesirable background and facilitating the separation of the supports subsequent to transfer. Accordingly, it has been found that these discharges creating an undesirable background can be eliminated by completely discharging the photoconductive support prior to or at the time that the dielectric and photoconductive supports are separated by directing light energy at the photoconductive support in an amount sufficient to discharge the same. Furthermore, it has been found that the utilization of this light energy does not alter or change the image of the charges transferred to the dielectric support, thereby producing a completely clean copy free of any discharges occurring during separation since the photoconductive support has been completely discharged of any residual charge prior to separation. Also, it has been found that by, in effect, erasing the photoconductive surface prior to separation, thereby producing reproductions or images of improved quality, these photoconductive surfaces may be more rapidly utilized subsequent to the initial imaging.

It is, therefore, the primary object of the present invention to provide a process and apparatus for effecting electrophotographic reproduction without the production of undesirable background discharge lines.

It is a further object of the present invention to provide a process wherein the photoconductive layer is completely discharged by directing light energy at the same at point in time prior to the separation of the dielectric and photoconductive layers or supports.

It is a still further object of the present invention to provide a process wherein an electrophotograpic image is transferred from a photoconductive layer to a dielectric layer, while the same are in virtual contact, followed by completely discharging the photoconductive layer with a source of light energy prior to the separation of the dielectric and photoconductive layers.

Still further objects and advantages of the process and apparatus of the present application will become more apparent from the following more detailed description thereof.

FIG. 1 is a diagrammatical illustration of a plate-type electrophotographic reproduction apparatus according to the instant invention, and FIG. 2 is a diagrammatical illustration of a continuously operating strip-type electrophotographic reproduction apparatus according to the instant invention.

DESCRIPTION OF THE PREFERRED EMBODIMENTS

The process according to the invention can be applied to any known photoconductive layer, particularly those with a selenium or zinc oxide base, deposited on rigid or flexible supports. Also, the dielectric support can be rigid or flexible.

The invention also relates to devices for embodying the process and has for its object electrophotographic reproduction devices wherein a charge image which has been formed on a photoconductive support is transferred onto a dielectric support in contact with the photoconductive support, characterized in that these devices comprise a source of light energy which exposes the photoconductive support after transfer of the virtual image on the dielectric support but before, or at the latest during, the separation of the two supports.

The light energy source can be stationary or mobile, and made up of a single or several light elements; it can act continuously or intermittently and should emit only radiations located in the absorption spectrum of the photoconductive layer and be sufficiently powerful to discharge the latter completely.

Figure 1:
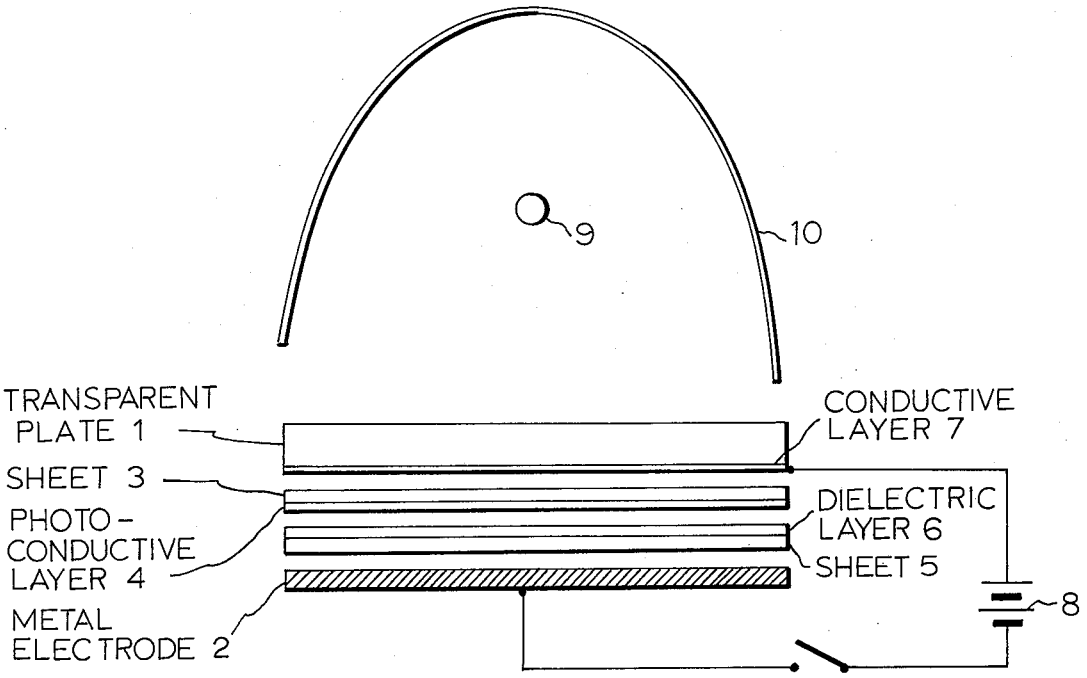

According to a first embodiment shown diagrammatically in accompanying FIG. 1, an electrophotographic reproduction apparatus comprises a conductive transparent plate 1, having a conductive layer 7, such as Nesa glass, and a plate-shaped metal electrode 2. Between plate 1 and electrode 2 is placed a transparent or translucid sheet 3, such as paper coated with a photocoductive layer 4 having an image of charges formed by any conventional means, and a sheet 5 covered with an insulating layer 6. Sheet 3 and sheet 5 are placed so that the photoconductive layer and the dielectric layer face one another, so that the back of the photoconductive sheet is turned toward plate 1 and the back of the dielectric sheet is turned toward metal electrode 2.

The apparatus includes a source of direct-current voltage 8 so as to establish an electric field between plate 1 and electrode 2. This field influences the transfer of the charges from the photoconductive sheet 3 onto the dielectric sheets.

A light source 9, associated with a reflector 10 of suitable shape and operated by a switch, not shown, exposes photoconductive surface 4 through plate 1 and transparent support 3, discharging photoconductive layer 4 of its residual charges, after the image of the charges has been transferred onto the dielectric sheet. When the photoconductive layer 4 has been discharged by light, no undesirable discharge is produced as the dielectric sheet is separated from the photoconductive sheet.

Figure 2:
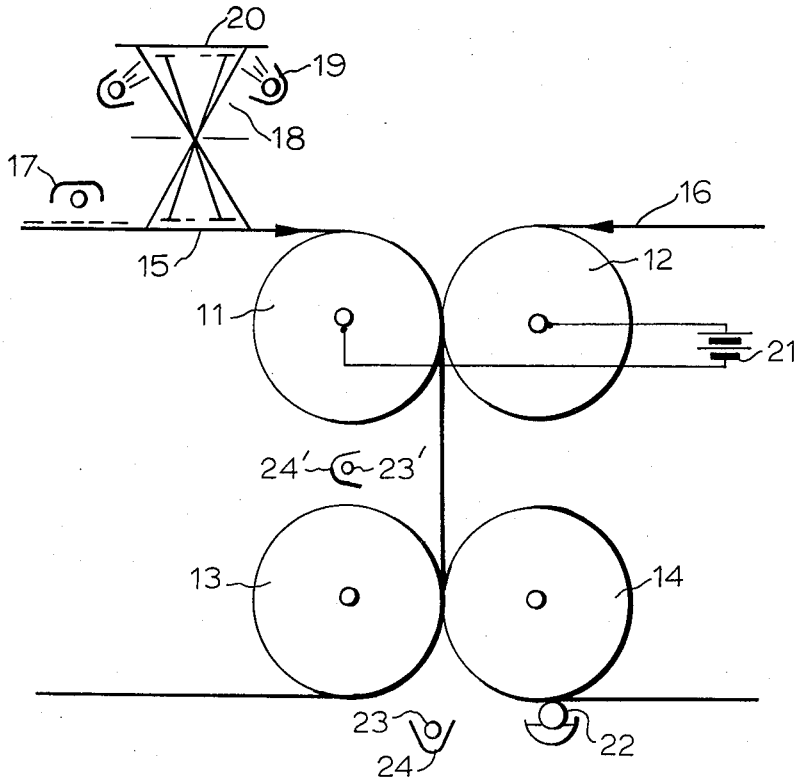

A second embodiment of the present invention is shown diagrammatically by accompanying FIG. 2.

This reproduction device which operates continuously comprises two pairs of rollers 11 and 12 and 13 and 14 around which travels, on the one hand, a strip of photoconductive paper 15 having a photoconductive layer, such as a zinc oxide base, turned toward the outside and a strip of dielectric paper 16 having a dielectric layer also turned toward the outside so that these two layers pass by facing one another.

A charge is placed on photoconductive strip 15 by a conventional means such as a corona charging device 17 and the strip 15 passes station 18 to produce a charge image corresponding to an original 20 which has been illuminated by lights 19. A direct current generator 21 establishes an electric field between rollers 11 and 12 which are formed from a conductive material which facilitates the transfer of the charge image formed on photoconductive strip 5 onto dielectric strip 16.

Continuing their travel in contact with one another, the two strips 5 and 6 go around rollers 13 and 14 before separating. Further is provided a conventional developing device 22 for developing and fixing the latent image formed on dielectric strip 16.

According to the invention, the device comprises an elongated light source 23 of a length equal to the width of the strip 15, provided with a reflector 24.

The light rays emitted by source 23 strike photoconductive strip 15 at the point of tangential contact of rollers 13 and 14, i.e., at the precise point where the photoconductive strip 15 separates from dielectric strip 16 so as to eliminate any undesirable discharge between the two strips and to prevent the appearance of Lichtenberg figures on the dielectric strip.

Also, when the support of the photoconductive strip 15 is made from transparent or translucid material, the same result is obtained if light source 23 is placed at 23' and reflector 24 at 24'.

While the process and apparatus of the present invention have been illustrated by way of the foregoing embodiments, the present invention is to be in no way limited thereto but construed as broadly as any equivalents of the following appended claims.

We claim:

1. A process of electrophotographic reproduction, wherein a charged image formed on a photoconductive support having an electrically conductive layer is transferred after its formation on the photoconductive support, from the photoconductive support onto a dielectric support by placing said photoconductive support and said dielectric support in abutting relationship between two electrodes, while an electric field generated by the electrodes is maintained thereacross, and then developing the image formed on said dielectric support after separating the dielectric from the photoconductive support, the improvement comprising the step of:

discharging the photoconductive support completely during a time subsequent to transferring said charged image to said dielectric support and prior to or simultaneous with separation of the dielectric support from the photoconductive support, said discharge being effected solely by directing light energy onto said photoconductive support with an intensity sufficient to discharge said photoconductive support completely.

2. The process of claim 1, wherein said light energy is directed onto said photoconductive support prior to separating said photoconductive support and said dielectric support.

3. The process of claim 1, wherein said light energy is directed onto said photoconductive support simultaneously with separating said photoconductive support and said dielectric support.

4. The process of claim 3, wherein the photoconductive support and dielectric support are placed in abutting relationship, while being advanced along parallel paths, and wherein the photoconductive support and dielectric support are separated along a line of separation perpendicular to the paths, the light energy being impinged on the photoconductive support at the line of separation.

5. The process of claim 1 wherein the photoconductive support comprises a photoconductive layer on a transparent electrically conductive support, said light energy being directed through said transparent support so as to completely discharge said photoconductive layer at a time subsequent to the transfer of charge image to the said dielectric support and prior to the separation of said photoconductive support and said dielectric support.

* * * * *